US006214212B1

(12) United States Patent
Megonnell et al.

(10) Patent No.: US 6,214,212 B1
(45) Date of Patent: Apr. 10, 2001

(54) METHOD FOR REMOVAL OF HYDROGEN SULFIDE FROM GASEOUS AND LIQUID STREAMS BY CATALYTIC CARBON

(75) Inventors: Neal E. Megonnell, Pittsburgh; Robert H. Vaughn, Bethel Park, both of PA (US)

(73) Assignee: Calgon Carbon Corporation, Pittsburgh, PA (US)

( * ) Notice: Subject to any disclaimer, the term of this patent is extended or adjusted under 35 U.S.C. 154(b) by 0 days.

(21) Appl. No.: 09/078,749

(22) Filed: May 14, 1998

(51) Int. Cl.[7] ..... C10G 29/20

(52) U.S. Cl. ..... 208/237

(58) Field of Search ..... 208/237

(56) References Cited

U.S. PATENT DOCUMENTS

| | | | | |
|---|---|---|---|---|
| 4,072,479 | * | 2/1978 | Sinaha et al. | 77/73 |
| 4,072,480 | * | 2/1978 | Wagner | 55/73 |
| 4,675,115 | * | 6/1987 | Hesselbrein | 210/673 |
| 4,855,276 | * | 8/1989 | Osborne | 502/415 |
| 5,024,682 | * | 6/1991 | Turk | 55/73 |
| 5,063,196 | * | 11/1991 | Doughty et al. | 502/417 |
| 5,125,934 | * | 6/1992 | Krisnamuryhy | 55/62 |
| 5,470,748 | * | 11/1995 | Hayden | 436/37 |
| 5,494,869 | * | 2/1996 | Hayden | 502/222 |

* cited by examiner

*Primary Examiner*—Helane E. Myers
(74) *Attorney, Agent, or Firm*—Cohen & Grigsby, P.C.

(57) ABSTRACT

An improved process is provided for the chemical conversion and removal of hydrogen sulfide from gaseous and liquid streams by contacting a low temperature catalytically-active carbonaceous char capable of rapidly decomposing hydrogen peroxide in an aqueous solution with said stream.

12 Claims, No Drawings

METHOD FOR REMOVAL OF HYDROGEN SULFIDE FROM GASEOUS AND LIQUID STREAMS BY CATALYTIC CARBON

FIELD OF THE INVENTION

The present invention relates to process of chemical conversion and removal of hydrogen sulfide from gaseous and liquid streams, and in particular to a process that converts and removes hydrogen sulfide from gaseous and liquid streams containing same by contacting such streams with a low temperature catalytically-active carbonaceous char.

BACKGROUND OF THE INVENTION

Hydrogen sulfide is characterized by a well-known "rotten egg" odor and is prevalent at most wastewater treatment plants. Although hydrogen sulfide can be fatal at high concentrations in the gaseous phase, the need for treatment is generally governed by the objectionable odor. Aqueous phase hydrogen sulfide is present in several areas of the United States, especially parts of Florida and California. Aqueous phase hydrogen sulfide can cause an odor problem depending on the pH of the water, however, the major concern is the objectionable taste imparted on the water by the dissolved hydrogen sulfide. Activated carbon has been known to remove hydrogen sulfide from both gaseous and aqueous phases through a catalytic oxidation process. The reaction rate of the catalytic oxidation process has generally been too slow to be commercially viable, therefore, the use of chemical impregnants added to the activated carbon or chemical addition to the gaseous or aqueous streams was necessary.

The use of activated carbon impregnated with caustic compounds such as sodium hydroxide and potassium hydroxide has been practiced for many years. The use of the caustic impregnation increases the reaction rate of the hydrogen sulfide oxidation. The majority of the hydrogen sulfide is oxidized to elemental sulfur while a minor portion is converted to sulfuric acid. After a sodium hydroxide impregnated carbon has become exhausted and can no longer convert additional hydrogen sulfide, the carbon can be chemically regenerated with a 50% sodium hydroxide solution. This process, although commercially viable, results in the generation of a sulfur containing caustic waste, which must be properly disposed. Caustic impregnated materials are also known to be susceptible to uncontrolled thermal excursions resulting from a suppressed combustion temperature caused by the caustic impregnation.

Other impregnants such as potassium iodide have been used to increase the reaction rate of hydrogen sulfide oxidation. Although the use of potassium iodide increases the reaction rate, and reduces the potential for uncontrolled thermal excursions, the major reaction product is elemental sulfur. The formation of elemental sulfur significantly reduces the possibility of chemical regeneration due to the stability of the elemental sulfur in the carbon pore structure. The possibility of thermal reactivation is also substantially reduced due to the need to scrub reactivation off gases that would contain high concentrations of sulfur dioxide.

Addition of chemicals to gaseous streams has also been practiced commercially. The addition of ammonia to gas streams containing hydrogen sulfide has been shown to increase the reaction rate of the hydrogen sulfide oxidation, however, the resulting reaction product is overwhelmingly elemental sulfur, resulting in a one-time use of the activated carbon.

All of the prior art methods for improving the removal of hydrogen sulfide from gaseous streams have certain disadvantages, which make the processes unattractive from a commercial standpoint. Chief among these is an inability to determine in a rapid and convenient manner the suitability of a char for such applications prior to its use, in particular the intrinsic catalytic activity of the char for hydrogen sulfide conversion. As a result of this shortcoming, it is not possible to know or even to estimate during the preparation of a char the utility of the final product short of actual testing in the application itself. None of the measures of typical char properties, e.g. iodine number and apparent density, has ever shown a clear correlation with utility in these applications, although some are known to affect overall reaction rates, primarily as a result of mass transport effects. This can be seen more clearly when several chars possessing nearly identical physical properties are contacted with a given hydrogen sulfide-containing process stream, yet show significantly different rates of hydrogen sulfide conversion and removal.

Accordingly, it is the object of the present invention to provide an improved process for the catalytic chemical conversion and removal of hydrogen sulfide in gaseous and liquid media by contacting said media with a carbonaceous char in which the intrinsic catalytic activity of the char is measured and known prior to use. It is further the object of the present invention to use the intrinsic catalytic activity of the char measured by a rapid and simple test as an indication suitability of the char for the application of hydrogen sulfide conversion.

SUMMARY OF THE INVENTION

In general, the present invention comprises a process for the catalytic chemical conversion and removal of hydrogen sulfide from gaseous and liquid streams by contacting such process streams with a low temperature catalytically active carbonaceous char. Preferably the carbonaceous char is one which can rapidly decompose hydrogen peroxide in aqueous solution. More specifically, the carbonaceous char is preferably the low temperature char described in Ser. No. 09/079,424 filed May 14, 1998, incorporated herein by reference. Surprisingly, when tested under conditions wherein those char properties known to affect adsorption capacity are held nearly equivalent, e.g. under conditions of nearly equivalent apparent density and iodine number, the rate at which the char can decompose hydrogen peroxide has been found to provide a good indication of the utility of the char for hydrogen sulfide conversion and removal. The rate of hydrogen peroxide the test described in U.S. Pat. No. 5,470,748 incorporated herein by reference, and is reported, except where noted, as the t-¾ time, measured in minutes. In the present invention it is found that chars having the highest utility for hydrogen sulfide conversion and removal are those having t-¾ times of 15 minutes or less, preferably 10 minutes or less.

PRESENTLY PREFERRED EMBODIMENTS

The utility of the invention is illustrated by the following three examples. Example 1 demonstrates the removal capability of two commercial activated carbons and several catalytically active materials with similar properties other than catalytic activity. Example 2 demonstrates the capability of several catalytically active materials with similar properties other than catalytic activity. Example 3 demonstrates the capability of a low temperature catalytically-active activated carbon.

EXAMPLE 1

Two commercially available activated carbons BPL and BPL-F3 (manufactured by Calgon Carbon Corporation, Pittsburgh, Pa.) were screened to a standard Tyler mesh size of 12×14. Each carbon was placed in a one inch inside diameter glass column to a carbon bed depth of one inch. The activated carbon samples were exposed to a synthetic gas stream consisting of 100 ppmV hydrogen sulfide, 20% by volume oxygen, 2% by volume water, balance nitrogen at room temperature (23° C.). The flow rate of the inlet gas stream was 2.34 actual liters per minute. The effluent hydrogen sulfide concentration was monitored for hydrogen sulfide breakthrough until the effluent hydrogen sulfide concentration reached 1 ppmV. Five samples of catalytically-active materials with various t ¾ times measured at pH 7 were tested using identical conditions. The time to reach the 1 ppmV effluent hydrogen sulfide concentration is presented in TABLE 1.

TABLE 1

| Sample | t-¾ Time (minutes) | Time to 1 ppmV Hydrogen Sulfide Breakthrough (minutes) |
|---|---|---|
| BPL-F3 | 36.1 | 4 |
| BPL | 14.9 | 590 |
| Catalytically Active | 9.9 | 625 |
| Catalytically Active | 7.5 | 680 |
| Catalytically Active | 4.1 | 717 |
| Catalytically Active | 2.9 | 746 |
| Catalytically Active | 2.2 | 965 |

EXAMPLE 2

Three activated carbon materials with similar properties other than catalytic activity as measured by the t ¾ time at pH 12 were screened to a Tyler 8×30 mesh. Each sample was poured into a separate one inch inside diameter glass column to a one-inch bed depth. The samples were exposed to a 100 ppmV hydrogen sulfide, 20% by volume oxygen, 2% by volume water, balance nitrogen gas stream at room temperature (23°). The flow rate of the inlet gas stream was 2.34 actual liters per minute. The effluent hydrogen sulfide concentration was monitored until the hydrogen sulfide concentration reached 1 ppmV. The time to reach 1 ppmV is presented in TABLE 2.

TABLE 2

| Sample | t-¾ Time (minutes) | Iodine Number (mg/g) | Apparent Density (g/cc) | Time to 1 ppmV Hydrogen Sulfide Breakthrough (minutes) |
|---|---|---|---|---|
| Catalytically Active | 2.7 | 1075 | 0.53 | 554 |
| Catalytically Active | 14.6 | 1066 | 0.53 | 413 |
| Catalytically Active | 42.7 | 1066 | 0.53 | 360 |

EXAMPLE 3

A low temperature catalytically-active carbon, the t-¾ time of which was determined at pH 7 was exposed to a 100 ppmV hydrogen sulfide, 20% by volume oxygen, 2% by volume water, balance nitrogen gas stream at room temperature (23°). The flow rate of the inlet gas stream was 2.34 actual liters per minute. The effluent hydrogen sulfide concentration was monitored until the hydrogen sulfide concentration reached 1 ppmV. The time to reach 1 ppmV is presented in TABLE 3.

TABLE 3

| Sample | t-¾ Time (minutes) | Iodine Number (mg/g) | Apparent Density (g/cc) | Time to 1 ppmV Hydrogen Sulfide Breakthrough (minutes) |
|---|---|---|---|---|
| Low-Temperature Catalytically Active | 4.8 | 1012 | 0.53 | 680 |

From the foregoing examples, the t-¾ time is a good predictor of the performance of the catalytically active carbonaceous char in the conversion of hydrogen sulfide. A lower t-¾ time provides a longer on-stream time to breakthrough of hydrogen sulfide.

While presently preferred embodiments of the invention have been described in particularity, the invention may be otherwise embodied within the scope of the appended claims.

What is claimed is:

1. A preocess for the removal of hydrogen sulfide from a gaseous liquid stream containing said hydrogen sulfide comprising the step of contacting a low temperature catalytically active carbonaceous char having a t-¾ time less than about 15 minutes with said stream in the presence of oxygen and water.

2. A process of claim 1 wherein said t-¾ time of said catalytically active carbonaceous char is less than about 10 minutes.

3. A process of claim 1 where the t-¾ time of said catalytically active carbonaceous char is less than about 5 minutes.

4. A process of claim 1 where said catalytically active carbonaceous char is granular, pelleted, shaped, or powdered.

5. A process of claim 1 where said catalytically active carbonaceous is formed, bonded, or otherwise incorporated into a unitized body for use as a filtration media.

6. A process of claim 1 where said catalytically active carbonaceous char is a fiber, fabric, or cloth.

7. A process of claim 1 wherein said catalytically active carbonaceous char is derived from any carbon-containing material.

8. A process of claim 1 wherein said catalytically active carbonaceous char is activated carbon.

9. A process of claim 1 wherein said catalytically active carbonaceous char is produced by the steps of (a) combining a nitrogen-containing material or materials with a carbon-containing material to produce a mixture, (b) carbonization of said mixture at temperatures less than 600° C., (c) oxidation of the carbonized mixture during or after said carbonization at temperatures less than 600° C., (d) increasing the temperature of the carbonized and oxidized mixture to above 600° C. to prepare a low-temperature catalytically active carbonaceous char.

10. A process of claim 9 including contacting the product of step (c) with a nitrogen-containing compound, said compound having at least one nitrogen containing functionality in which the nitrogen exhibits a formal oxidation number of less than zero, during or before step (d).

11. A process of claim 10 including step (e) activation of said high temperature catalytically active carbonaceous char at temperatures above 600° C. using $H_2O$, $CO_2$, or $O_2$ or combinations thereof to provide an activated catalytically active carbonaceous char.

12. A process of claim 11 including step (e) activation of said high temperature catalytically active carbonaceous char at temperatures above 600° C. using $H_2O$, $CO_2$, or $O_2$ or combinations thereof to provide an activated catalytically active carbonaceous char.

* * * * *